United States Patent [19]

Kusayama

[11] Patent Number: 4,817,252

[45] Date of Patent: Apr. 4, 1989

[54] FLUID-TIGHT SLIDE FASTENER

[75] Inventor: Masahiro Kusayama, Kurobe, Japan

[73] Assignee: Yoshida Kogyo K. K., Tokyo, Japan

[21] Appl. No.: 110,618

[22] Filed: Oct. 20, 1987

Related U.S. Application Data

[63] Continuation of Ser. No. 46,577, May 6, 1987.

[30] Foreign Application Priority Data

May 6, 1986 [JP] Japan ..... 61-68059[U]

[51] Int. Cl.[4] ..... A44B 19/32

[52] U.S. Cl. ..... 24/389; 24/381; 24/384

[58] Field of Search ..... 24/389, 384, 381, 419, 24/433, 436

[56] References Cited

U.S. PATENT DOCUMENTS

| | | | |
|---|---|---|---|
| 2,515,376 | 7/1950 | Krupp | 24/389 |
| 2,535,391 | 12/1950 | Clarke | 24/389 |
| 2,557,827 | 6/1951 | Krupp | 24/389 |
| 2,800,699 | 7/1957 | Armstrong | 24/389 |
| 3,668,745 | 6/1972 | Krupp | 24/389 |
| 3,685,103 | 8/1972 | Severino | 24/381 |
| 3,864,792 | 2/1975 | Takahashi et al. | 24/205.11 R |
| 3,869,765 | 3/1975 | Fukuroi | 24/205.11 R |
| 3,874,037 | 4/1975 | Takamatsu | 24/389 |
| 3,895,418 | 7/1975 | Ebata | 24/205.11 F |
| 3,959,858 | 6/1976 | Fukuroi | 24/205.11 R |
| 4,488,338 | 12/1984 | Takahashi | 24/389 |
| 4,513,482 | 4/1985 | Fukuroi | 24/384 |
| 4,524,493 | 6/1985 | Inamura | 24/389 |
| 4,658,480 | 4/1987 | Morioka et al. | 24/389 |

FOREIGN PATENT DOCUMENTS

| | | | |
|---|---|---|---|
| 58-181210 | 12/1983 | Japan . | |
| 58-181211 | 12/1983 | Japan . | |
| 59-93208 | 6/1984 | Japan . | |
| 59-93209 | 6/1984 | Japan . | |
| 59-25223 | 7/1984 | Japan . | |
| 59-41693 | 12/1984 | Japan . | |
| 59-51805 | 12/1984 | Japan . | |
| 879771 | 10/1961 | United Kingdom . | |
| 1201290 | 8/1970 | United Kingdom | 24/389 |

*Primary Examiner*—Victor N. Sakran

*Attorney, Agent, or Firm*—Hill, Van Santen, Steadman & Simpson

[57] ABSTRACT

A fluid-tight slide fastener comprising a pair of stringers each having a support tape and a row of coupling elements mounted on and along a folded inner longitudinal tape edge, a slider slidably mounted on the opposed rows of coupling elements, and an end stop mounted on the tapes and having embedded therein a length of the folded edge. Each folded edge includes a sealing abutment extending over a specified length of permenently interengaged coupling element rows adjacent the end stop. The opposed sealing abutments define a substantially inverted "V" cross-sectional profile.

2 Claims, 2 Drawing Sheets

FLUID-TIGHT SLIDE FASTENER

This is a continuation of appliction Ser. No. 046,577, filed May 6, 1987.

BACKGROUND OF THE INVENTION

1. Field of the Invention

This invention relates generally to slide fasteners and more particularly to such slide fasteners as are suitable for fluid-tight applications.

2. Description of the Prior Art

There have been proposed numerous types of fluid-tight slide fasteners for use on for example diving suits, life jackets and other articles requiring hermetic seal against leakage.

A typical known fluid-tight slide fastener comprises a pair of stringers each having a support tape resistant to leakage and a row of coupling elements mounted on one longitudinal edge of the tape, the stringers being coupled and uncoupled by a slider. To establish fluid-tightness of the slider, the longitudinal edge of the support tape is folded around the row of elements and the thus folded tape edge is externally enveloped by a row of sealing clamps positioned in registry with corresponding individual elements. Each of the confronting edges of the respective tapes includes a vertical rise portion extending between the folded portion and the flat tape web, the rise portion being relatively long (as shown in FIGS. 5 and 6 of the accompanying drawings illustrating a prior art example) so as to allow smooth, unrestricted movement of the slider. This prior art fastener however is vulnerable because the rise portions of the tapes being relatively long tend to crush apart or split under the influence of vertically exerted pressures as indicated by dotted lines in FIG. 5, where the flat tape webs at their respective ends are bonded to backing strips.

There is another prior art example of fluid-tight slide fastener in which the rise tape portions referred to above are relatively short so as to eliminate the possibility of the tape crushing apart or splitting, but this example makes it unsmooth, if not difficult, for the slider to move along in normal operation of the slide fastener.

SUMMARY OF THE INVENTION

With the foregoing difficulties in view, the present invention provides an improved slide fastener for fluid-tight application which incorporates structural features such that the fastener tapes are held immune to splitting or crushing apart under severe pressures and allow smooth movement of the slider.

This and other objects and advantages of the invention will appear clear from the following description taken in connection with the accompanying drawings, in which like reference numerals refer to like or corresponding parts throughout the several views.

DETAILED DESCRIPTION

Figure 1:
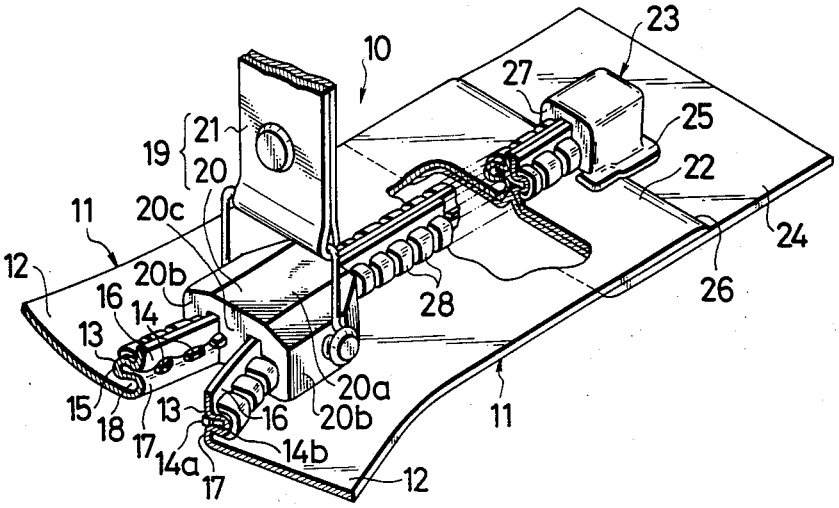
FIG. 1 is a perspective view of a principal portion of a fluid-tight slide fastener embodying the invention.

Referring now to FIG. 1, there is shown a fluid-tight slide fastener 10 embodying the present invention, the fastener 10 comprising a pair of stringers 11 each including a support tape 12 coated with rubber or other impermeable material and carrying on and along its inner longitudinal edge 13 a row of coupling elements 14 which is presently illustrated to be of a discrete formation in contrast to a continuous formation. Each individual element 14 has a coupling head portion **14*a* engageable with the corresponding coupling head portion 14*a* on the mating or opposite tape 12 and a heel portion 14*b* disposed remote from the coupling head portion 14*a*. The tape edge 13 is folded as at 15 around the heel portion 14*b* of and envelops the major portion of the coupling element 14 as better shown in FIGS. 3 and 4. On opposite ends of the folded portion 15 are upper and lower sealing abutments 16 and 17, respectively, which are brought together by a slider 19 to provide complete seal against leakage in a manner well known in the art. Designated at 28 are sealing clamps positioned in registry with corresponding elements 14 and stapled around the folded edge portion 15 of the tape 12 in a manner well known in the art. The tape edges 13 are raised with the coupling elements 14 above the flat web surface of the tapes 12 to provide a clearance 18 wide enough to permit the slider 19** to move smoothly therethrough.

The slider 19 is conventional in that it has a slider body 20 and a pull tab 21 with which to manipulate the slider 19.

The slider body 20 includes an upper plate **20*a*, a pair of side walls 20*b* extending along opposite longitudinal edges of the upper plate 20*a*, and a partition wall 20*c* disposed centrally between the side walls 20*b* and depending from the upper plate 20*a*, there being defined in the slider body 20 a generally Y-shaped guide channel not shown for the passage therethrough of the opposed rows of coupling elements 14 to come into or out of engagement with each other. The side walls 20*b* have respective flanges 20*e*, 20*e* inwardly directed toward each other and receivable in the clearance 18. The movement of the slider 19 is limited or stopped at the bottom end 22 of the stringer 11 by a bottom end stop 23** which may be applied for example by injection molding.

There is provided a backing sheet 24 which is partly connected and adhered to the lower surface of the bottom end portion 22 of the support tape 12 to reinforce the latter. The portion of the backing sheet 24 which is thus joined to the support tape 12 extends long enough to lie under the slider 19 when the latter is brought fully back in abutting engagement with the bottom end stop 23 as better shown in FIG. 2.

Figure 2:
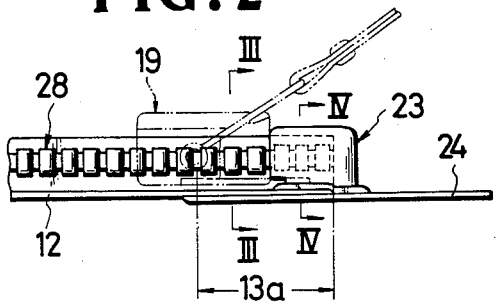
FIG. 2 is a side elevational view, partly sectional, of the slide fastener of FIG. 1.

The bottom end stop 23 is substantially in the form of a rectangular block which is made preferably of a thermoplastic resin for its feasibility of being molded into a desired shape and for its flexibility of yielding to pressures exerted by the slider 19. The end stop 23 has a bottom peripheral portion flattened out of provide a thin flared seat or fin 25 which is effectively anchored adhesively or fusibly partly to the bottom end 22 of the tape 12 and partly to the reinforcing backing 24 across a marginal end extremity 26 of the tape 12 as shown in FIGS. 1 and 2. The end extremity 26 is rounded off to facilitate the attachment of the end stop 23 and to minimize friction with ambient objects. The end stop 23 has a front vertical end wall 27 with which the slider 19 is brought in abutting engagement as shown in FIG. 2. The end stop 23 contains or has embedded therein a portion of interengaged folded edges 13 of the tape 12 including a plurality of coupling elements 14 and is thus attached adhesively, ultrasonically or by injection-molding to provide firm anchoring of the end stop 23 with respect to the support tape 12 against severe thrusting force of the slider 19.

A top end stop though not shown is substantially the same in construction as the bottom end stop 23 above described.

Figure 3:
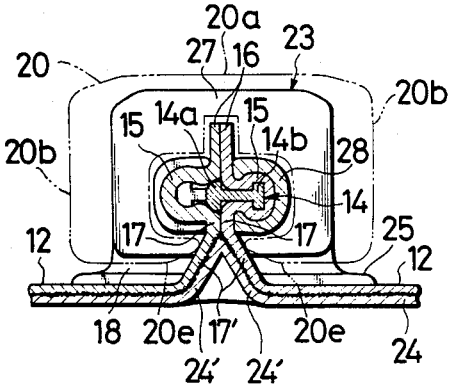
FIG. 3 is a cross-sectional view taken on the line III—III of FIG. 2.
Figure 4:
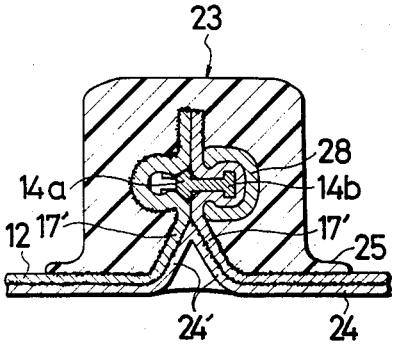
FIG. 4 is a cross-sectional view taken on the line IV—IV of FIG. 2.
Figure 5:
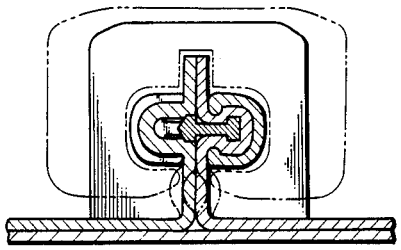
FIG. 5 PRIOR ART
FIG. 5 is a sectional view of a prior art fluid-tight slide fastener.
Figure 6:
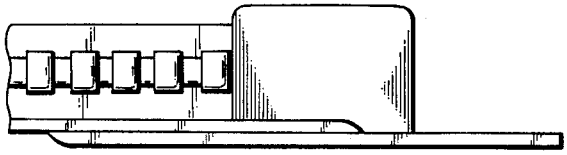
FIG. 6 PRIOR ART
FIG. 6 is a side elevation of the slide fastener of FIG. 5.

Now, according to an important feature of the invention, the slide fastener 10 has a length 13*a* of folded tape edge 13 which extends from within the end stop 23 over a plurality of coupling elements 14 permanently interengaged adjacent to the end stop 23, said length 13*a* defining an end region of stringers 11 in which confronting lower sealing abutments 17' of the respective tapes 12 are separated divergently at an angle to assume a substantially inverted "V" cross-sectional configuration as shown better in FIGS. 3 and 4. The portion 24' of the backing sheet 24 which is coextensive with the specified length 13*a* of stringers 11 is centrally flexed in conformity with and attached to the inverted "V" portion of the sealing abutments 17'. This structural feature serves to dissipate vertically exerted pressures which would otherwise work upon and cause the sealing abutments 17 to crush apart as in the case of a prior art counterpart shown in FIG. 5.

Figure 7:
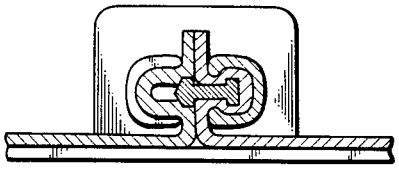
FIG. 7 PRIOR ART
FIG. 7 is a sectional view of another prior art fluid-tight slide fastener.

Another advantage of the invention is that the provision of the above configured sealing abutments 17' gives the clearance 18 a sufficient width to permit smooth movement of the slider 19 as compared to a prior art counterpart shown in FIG. 7.

Although various minor modifications may be suggested by those versed in the art, it should be understood that I wish to embody within the scope of the patent granted hereon, all such embodiments as reasonably and properly come within the scope of my contribution to the art.

What is claimed is:

1. A fluid-tight slide fastener comprising:

(a) a pair of stringers each having a water-proof support tape and a row of coupling elements mounted on and along a bent inner longitudinal edge of said support tape, said bent inner longitudinal edge having throughout the length thereof an intermediate portion folded around said row of coupling elements and upper and lower sealing abutments on opposite sides of said folded intermediate portion;

(b) a slider slidably mounted on the two rows of coupling elements for taking the latter into and out of coupling engagement with each other to close and open the slide fastener;

(c) an end stop mounted on one surface of said support tapes at one end of thereof and having embedded therein a length of said bent inner longitudinal tape edges; and (d) each of said bent inner longitudial tape edges including a longitudinal portion extending from within said end stop over a specified length of said coupling element rows permanently interengaged adjacent to said end stop, said lower sealing abutment of said longitudinal portion of each bent inner longitudinal tape edge defining jointly with the corresponding lower sealing abutment on the mating stringer a substantially inverted "V" cross-sectional configuration.

2. A fluid-tight slide fastener according to claim 1, further including a single backing sheet connected to the other surface of said support tapes and transversely coextensive with a combined width of said support tapes, said backing sheet having a central portion which is coextensive with said specified length of said permanently interengaged coupling elements and which is flexed in conformity with and attached to said inverted V-shaped lower sealing abutments.

* * * * *